US010704550B2

(12) United States Patent
De Schamphelaere

(10) Patent No.: US 10,704,550 B2
(45) Date of Patent: Jul. 7, 2020

(54) LIQUID INJECTED SCREW COMPRESSOR, CONTROLLER FOR THE TRANSITION FROM AN UNLOADED STATE TO A LOADED STATE OF SUCH A SCREW COMPRESSOR AND METHOD APPLIED THEREWITH

(71) Applicant: ATLAS COPCO AIRPOWER, naamloze vennootschap, Wilrijk (BE)

(72) Inventor: Pieter De Schamphelaere, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 556 days.

(21) Appl. No.: 14/917,190

(22) PCT Filed: Sep. 10, 2014

(86) PCT No.: PCT/BE2014/000044
§ 371 (c)(1),
(2) Date: Mar. 7, 2016

(87) PCT Pub. No.: WO2015/035478
PCT Pub. Date: Mar. 19, 2015

(65) Prior Publication Data

US 2016/0215777 A1 Jul. 28, 2016

(30) Foreign Application Priority Data

Sep. 11, 2013 (BE) ..... 2013/0599

(51) Int. Cl.
*F04C 28/24* (2006.01)
*F04C 28/06* (2006.01)
(Continued)

(52) U.S. Cl.
CPC ..... *F04C 28/24* (2013.01); *F04C 18/16* (2013.01); *F04C 28/06* (2013.01); *F04C 29/0014* (2013.01); *F04C 29/026* (2013.01)

(58) Field of Classification Search
CPC ..... F04C 14/24; F04C 14/26; F04C 18/16; F04C 18/18; F04C 27/00; F04C 27/02;
(Continued)

(56) References Cited

U.S. PATENT DOCUMENTS 3,961,862 A 6/1976 Edstrom et al.
4,068,980 A * 1/1978 Fine ..... F04C 28/06 417/27
(Continued)

FOREIGN PATENT DOCUMENTS

JP H09-222087 8/1997
JP H09-287580 11/1997
(Continued)

OTHER PUBLICATIONS

International Search Report (ISR) dated Mar. 5, 2015, for PCT/BE2014/000044.

*Primary Examiner* — Bryan M Lettman
*Assistant Examiner* — Charles W Nichols
(74) *Attorney, Agent, or Firm* — Bacon & Thomas, PLLC

(57) ABSTRACT

Liquid injected screw compressor with an inlet valve and blow-off valve; a liquid circuit with injector; a controller for the transition from unloaded to loaded, whereby when unloaded the inlet valve is closed and the blow-off valve is open, and when loaded the inlet valve is open and the blow-off valve is closed, and whereby during an aforementioned transition, when the injection pressure is below a minimum threshold, the inlet valve remains closed and is opened with a certain delay and that there are means to gradually increase the injection during this delay and to open
(Continued)

the inlet valve when the injection pressure has reached the minimum threshold.

18 Claims, 6 Drawing Sheets

(51) Int. Cl.
*F04C 18/16* (2006.01)
*F04C 29/00* (2006.01)
*F04C 29/02* (2006.01)

(58) Field of Classification Search
CPC ..... F04C 28/06; F04C 28/065; F04C 28/10; F04C 28/185; F04C 28/24; F04C 28/26; F04C 29/0007; F04C 29/0092; F04C 29/0014; F04C 29/02; F04C 29/026; F04C 29/04; F04C 29/042
See application file for complete search history.

(56) References Cited

U.S. PATENT DOCUMENTS 4,227,862 A 10/1980 Andrew et al.
5,636,973 A * 6/1997 Sonobe ..... F04B 27/1804 417/222.2
5,713,724 A * 2/1998 Centers ..... F04B 49/065 417/279
7,316,546 B2 * 1/2008 Daniels ..... F04C 18/16 417/295
7,607,899 B2 * 10/2009 Van Praag ..... F04B 49/225 417/440
2007/0140866 A1 6/2007 Tanaka
2008/0085180 A1 4/2008 MacKenzie et al.

FOREIGN PATENT DOCUMENTS

JP 2008-128085 6/2008
RU 1782293 12/1992
WO 2005/035989 A1 4/2005

* cited by examiner

| tB−tA | | tStop | | | |
|---|---|---|---|---|---|
| | | Ta>30°C | | Ta≤30°C | |
| | | >Ysec | ≤Ysec | >Zsec | ≤Zsec |
| | | hot | | cold | |
| tRun | < Xsec | 15sec | 15sec | 30sec | 30sec |
| | ≥ Xsec | 15sec | 3sec | 30sec | 3sec |

LIQUID INJECTED SCREW COMPRESSOR, CONTROLLER FOR THE TRANSITION FROM AN UNLOADED STATE TO A LOADED STATE OF SUCH A SCREW COMPRESSOR AND METHOD APPLIED THEREWITH

BACKGROUND OF THE INVENTION

The present invention relates to a liquid injected screw compressor and in particular the controller of such a screw compressor during a transition from an unloaded state, in brief unloaded, whereby no compressed gas is taken off, to a loaded situation, in brief loaded, whereby the screw compressor must supply compressed gas, for example compressed air.

SUMMARY OF THE INVENTION

More specifically the invention relates to a type of liquid injected screw compressor that comprises a compressor element with an inlet and a controllable inlet valve to be able to close the inlet; an outlet and a pressure pipe connected thereto that is connected to a downstream consumer network and a controllable blow-off valve for blowing off compressed gas into the environment; a liquid circuit with an injector for injecting liquid into the compressor element; a liquid separator provided in the pressure pipe to separate liquid from the compressed gas and a pressure vessel to collect the separated liquid; an injection pipe that connects the pressure vessel to the injector; a controller for controlling the inlet valve and the blow-off valve during a transition from an unloaded state to a loaded state when the pressure in the consumer network falls to a set desired minimum network pressure, whereby in the unloaded state the inlet valve is closed and the blow-off valve is open and in the loaded state the inlet valve is open and the blow-off valve is closed.

When unloaded the compressor element is not stopped and thus continues running. Due to the fact that in this case the inlet is closed, save for a few calibrated passages in the inlet valve, only a limited quantity of gas is drawn in and the pressure cannot build up as the gas drawn is immediately blown off to the atmosphere at the outlet.

In this way only a minimum of energy is required to keep the compressor element running when unloaded.

The transition from unloaded to loaded is initiated when the network pressure falls below a minimum value that is selected and adjusted by the user.

With the known screw compressors of the aforementioned type the inlet valve is immediately fully opened when the network pressure reaches the aforementioned set value, and the blow-off valve is fully closed simultaneously.

When the inlet valve is suddenly fully opened, a large quantity of drawn in gas is suddenly mixed with the liquid that is injected in the compressor element under the effect of the pressure that is in the pressure vessel at that time.

For energy reasons this pressure is kept as low as possible when unloaded, as the higher this pressure the more energy is required to keep the compressor element running when unloaded.

Due to the sudden supply of energy in the compressed gas when the inlet valve opens and due to the low quantity of injected liquid as a result of the low injection pressure at that time, undesired temperature peaks can suddenly occur in the outlet of the compressor element that can cause the failure of the screw compressor.

The solutions that exist for this, insofar available, are complex by nature and are thus not often applied and also have negative side effects that mean that during a transition from unloaded to loaded there is a certain reaction time in order to build up the desired pressures in the consumer network, whereby this reaction time is preferably kept as short as possible by the users.

The purpose of the present invention is to provide a solution to the aforementioned and other disadvantages.

To this end the invention concerns a liquid injected screw compressor of the aforementioned type, whereby the controller is such that upon a transition from unloaded to loaded, when the injection pressure lies below a minimum threshold, the inlet valve remains closed and is opened with a certain delay and that there are means to gradually increase the pressure in the pressure vessel during this delay in the opening of the inlet valve, and to only open the inlet valve when the injection pressure has reached the minimum threshold.

As a result this ensures that if the injection pressure is too low at the time of the transition from unloaded to loaded, this pressure is first raised to a minimum pressure above which the aforementioned risk of failure of the screw compressor is prevented.

As the injection pressure is directly dependent on the pressure in the pressure vessel, both the injection pressure and the pressure in the pressure vessel can be taken as a control parameter to determine the time at which the valve can be fully opened after the delay without the risk of temperature peaks.

For a certain screw compressor the minimum injection pressure can be determined experimentally, above which the aforementioned risk of failure of the screw compressor is completely eliminated, and for the control the inlet valve can simply be fully opened at the time that the injection pressure reaches this value, which enables a simple control.

In order to keep the delay in fully opening the inlet valve as short as possible it is useful to build up the pressure in the pressure vessel during the delay as quickly as possible until the minimum value for opening the inlet valve, and thus to keep this minimum value as low as possible and to make the operating conditions of the screw compressor at the time of the transition from unloaded to loaded depend on the ambient temperature for example, whereby the risk threshold for the occurrence of temperature peaks depends on these operating conditions.

The controller can also be provided with an algorithm that determines the minimum injection pressure or the related pressure in the pressure vessel, for example by a calculation on the basis of the known characteristics of the screw compressor and the operating conditions or on the basis of experimental data that give the minimum pressure as a function of the operating conditions.

As a result the control is more complex, but the user will not have to wait as long for a sufficient pressure build-up in the network after a transition from unloaded to loaded.

According to a possible variant, the means for allowing the pressure in the pressure vessel to gradually increase during the transition from unloaded to loaded can be formed by a bypass with a calibrated opening to bypass the inlet valve for drawing in gas when the inlet valve is closed, whereby a controllable shut-off valve is provided in this bypass, whereby the control is such that the shut-off valve is closed in an unloaded state and opened during the transition from unloaded to loaded.

This variant provides the advantage that the existing inlet valves can easily be adjusted in the framework of the invention by providing an additional bypass across the inlet valve.

According to another possible variant, the means are realised by making the inlet valve and the blow-off valve controllable independently of one another and by the fact that the controller is such that during the transition the open blow-off valve is immediately closed when the pressure in the network falls to the minimum level, while the inlet valve is still closed until the time that the pressure in the pressure vessel has built up sufficiently.

The invention also relates to an electric or electronic controller to control a transition from unloaded to loaded as described above to prevent the injection pressure, at the time of opening the inlet valve, being lower than a minimum pressure below which there could be a risk of too high temperature peaks in the outlet of the compressor element.

The invention also relates to a method for controlling a liquid injected screw compressor of the aforementioned type, whereby during the transition from unloaded to loaded the method comprises the following steps:

- the determination of the pressure in the consumer network;
- the determination of the injection pressure or the pressure in the pressure vessel at the time that the pressure in the consumer network falls to the minimum network pressure;
- if the injection pressure or the pressure in the pressure vessel at that time is greater than or equal to a minimum value, then the inlet valve is immediately opened;
- if the injection pressure or the pressure in the pressure vessel at that time is less than the minimum value, then the inlet valve is opened with a certain delay and means are activated to allow the pressure in the pressure vessel to gradually increase during this delay in the opening of the inlet valve; and,
- the opening of the inlet valve when the injection pressure or the pressure in the pressure vessel has reached the aforementioned minimum value.

BRIEF DESCRIPTION OF THE DRAWINGS

With the intention of better showing the characteristics of the invention, a few preferred embodiments of a liquid injected screw compressor according to the invention and a controller for controlling the transition from unloaded to loaded and a method applied therewith are described hereinafter by way of an example, without any limiting nature, with reference to the accompanying drawings, wherein.

DETAILED DESCRIPTION OF THE INVENTION

Figure 1:
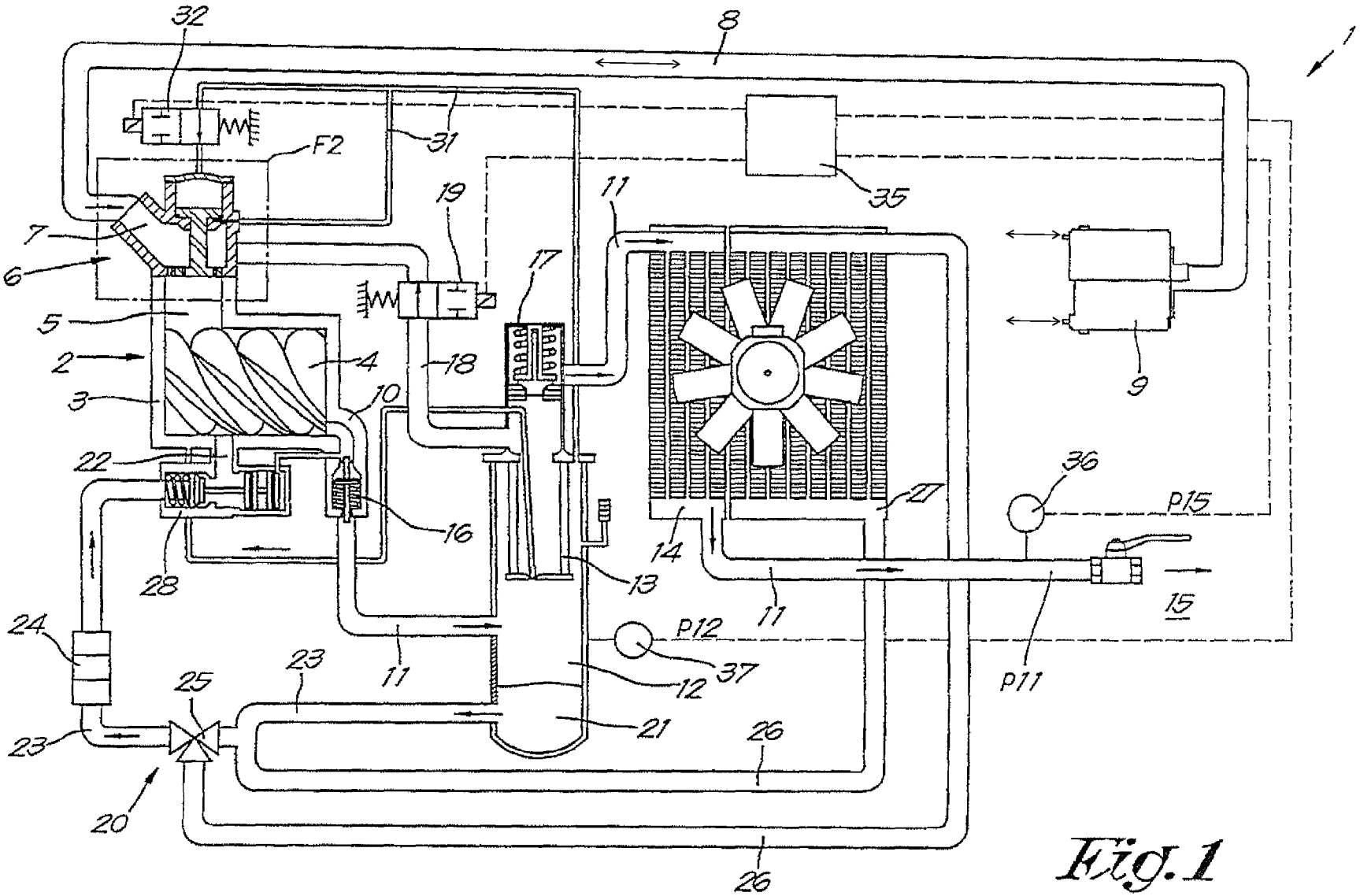
FIG. 1 schematically shows a liquid injected screw compressor according to the invention.

The installation shown in FIG. 1 is a liquid injected screw compressor 1 according to the invention, comprising a compressor element 2 of the known screw type with a housing 3 in which two meshed helical rotors 4 are driven by means of a motor or similar, not shown in the drawing.

The compressor element 2 is provided with an inlet 5 that can be shut off by means of a controllable inlet valve 6 with an inlet 7 that is connected by means of an intake pipe 8 to the inlet filter 9 to draw in gas, in this case air, from the environment.

The compressor element 2 is also provided with an outlet 10 and a pressure pipe. 11 connected thereto that is connected to a downstream consumer network 15 for the supply of various pneumatic tools or similar, that are not shown here, via a pressure vessel 12 with a liquid separator 13 therein and via a cooler 14.

A non-return valve 16 is provided on the outlet 10 of the compressor element 2, and a minimum pressure valve 17 is affixed to the output of the pressure vessel 12.

A blow-off branch 18 is provided in the pressure vessel 12 that opens out at the location of the inlet 7 of the inlet valve 6 and which can be shut off by means of the blow-off valve 19 in the form of a controllable electric valve.

The screw compressor 1 is provided with a liquid circuit 20 to inject liquid 21, in this case oil, from the pressure vessel 12 into the compressor element for lubrication and/or cooling and/or sealing between the rotors 4 together and the rotors 4 and the housing 3.

This liquid circuit 20 comprises an injector 22 or similar, which is connected to the pressurised liquid 21 in the pressure vessel 12 via an injection pipe 23 with a liquid filter 24 therein.

The liquid 21 that flows from the pressure vessel 12 to the injector 22 can be guided around through a liquid cooler 27, via a thermostatic valve 25 via a branch pipe 26, in order to control the temperature in the injection pipe.

A controlled shut-off valve 28 on the injector 22 prevents the liquid flowing back from the compressor element 2 to the pressure vessel 12, and liquid flowing from the pressure vessel 12 to the compressor element 2 when this compressor element 2 has stopped.

Figure 2:
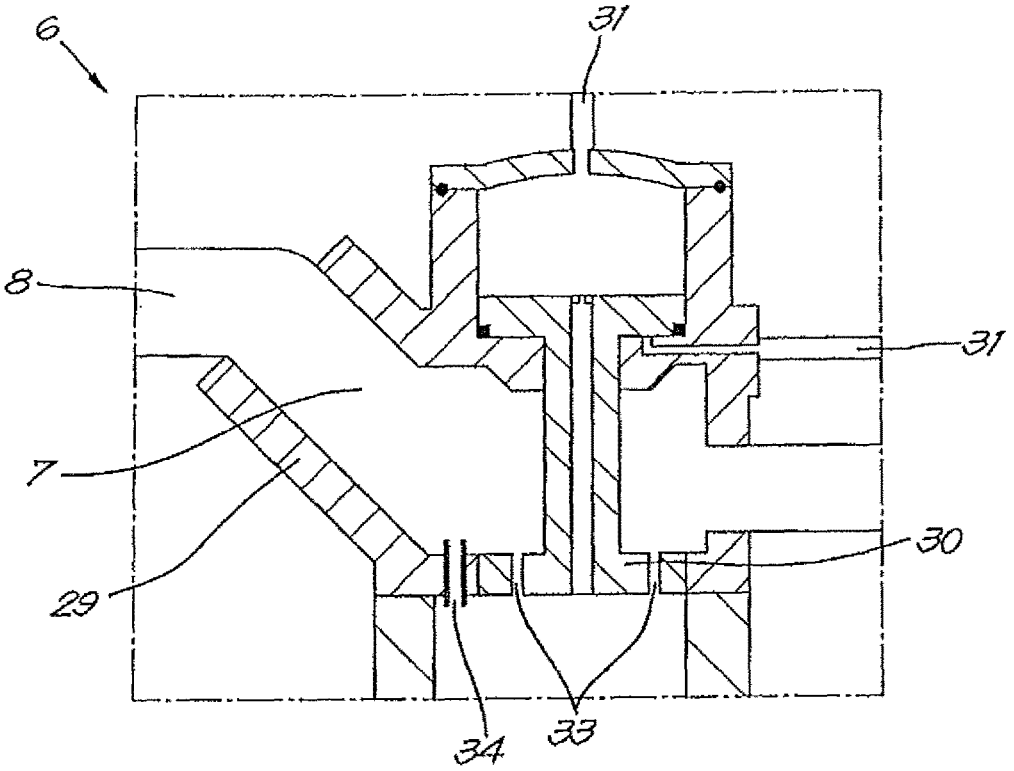
FIG. 2 shows the section that is indicated by the box F2 in FIG. 1.
Figure 5:
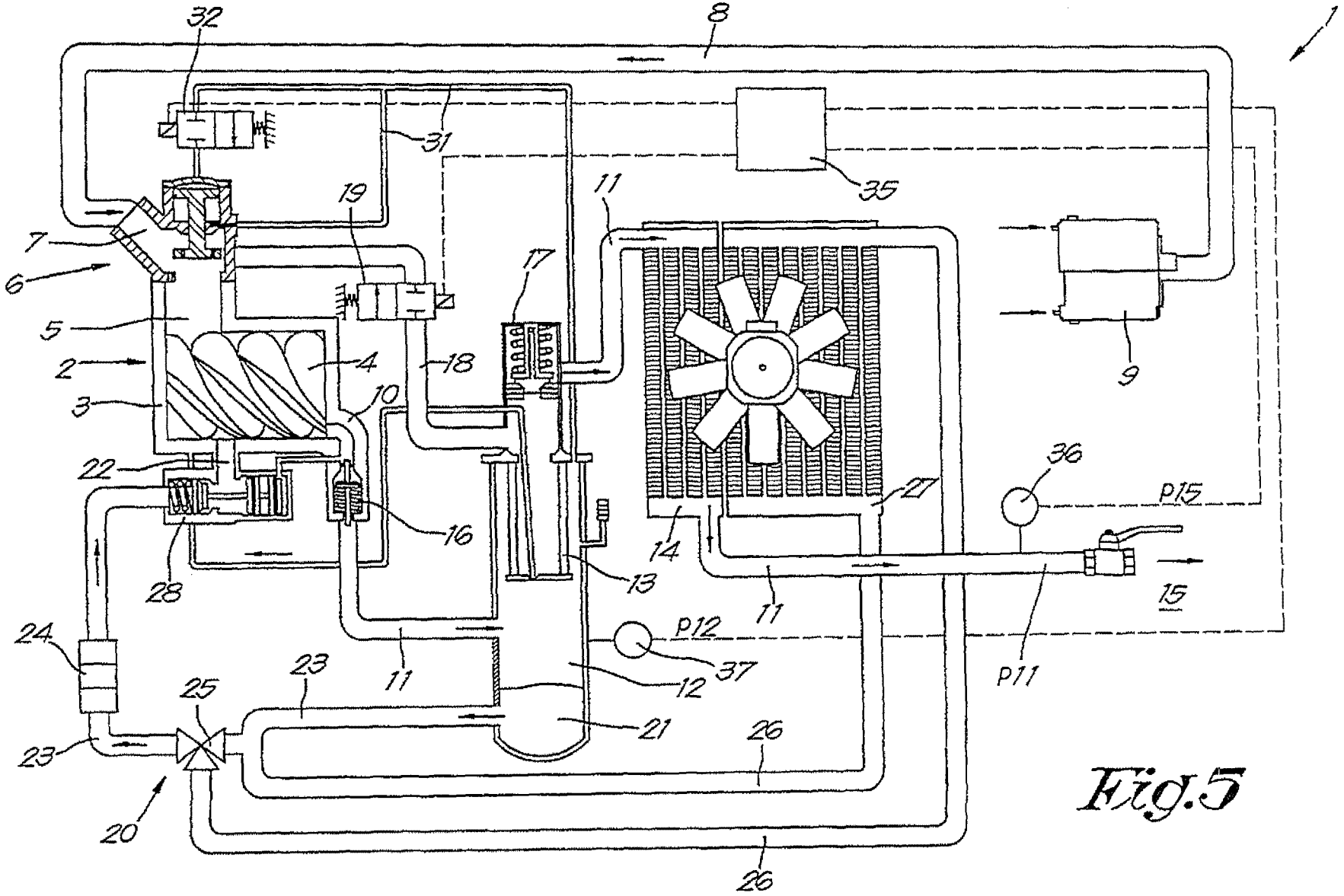

The inlet valve 6 is shown in more detail in FIG. 2 and consists of a housing 29 in which a poppet valve 30 is affixed movably between a state whereby the inlet 5 of the compressor element 2 is closed, as shown in FIG. 1 and a state in which the inlet 5 is open to a maximum, as shown in FIG. 5.

In this case, the inlet valve 6 is opened and closed in a known way under the effect of a control pressure that is tapped off from the cover of the pressure vessel 2 via a control pipe 31 for example, and is allowed through by means of a control valve 32 or similar to close the inlet valve 6 or is closed to open the inlet valve 6.

In the poppet valve 30 itself and in the housing 29 of the inlet valve 6, calibrated passages, respectively 33 and 34, are provided that ensure a permanent connection between the inlet 7 of the inlet valve 6 and the inlet 5 of the compressor element 2 in order to be able to draw in air in a controlled way when the inlet valve 6 is closed.

Furthermore, an electric or electronic controller 35 is provided to control the pressure p15 in the consumer network 15 within a pressure interval that is defined by a minimum network pressure p15min and a maximum network pressure p15max that can be selected by the user of the screw compressor 1 and entered in the controller 35, and which to this end is connected to a pressure sensor 36 to measure or determine the pressure p15 in the consumer network 15.

The controller 35 is further provided with software or similar to control the inlet valve 6 via the control valve 32 and the blow-off valve 19 in such a way that when the air pressure in the consumer network 15 falls below the minimum network pressure p15min due to the offtake of air, the screw compressor is brought to a loaded state whereby the inlet valve 6 is open and the blow-off valve is closed until no further compressed air is taken off and as a result the pressure p15 in the consumer network 15 rises.

From the time that the pressure p15 reaches the maximum network pressure p15max, the controller switches over from the loaded state to an unloaded state whereby the inlet valve is closed and the blow-off valve is opened as shown in FIG. 1.

As a result no air is drawn in by the compressor element 2 that is still being driven, aside from a small quantity that is drawn in via the calibrated passages 33 and 34 and compressed.

As a result an equilibrium occurs in the pressure vessel 12 with a constant pressure p12*u* whose value depends on the selected calibrated passages that are preferably selected so that this pressure p12*u* is as low as possible when unloaded.

This pressure p12*u* is measured using the pressure sensor 37 for example, whose signal is fed back to the controller 35.

Figure 3:
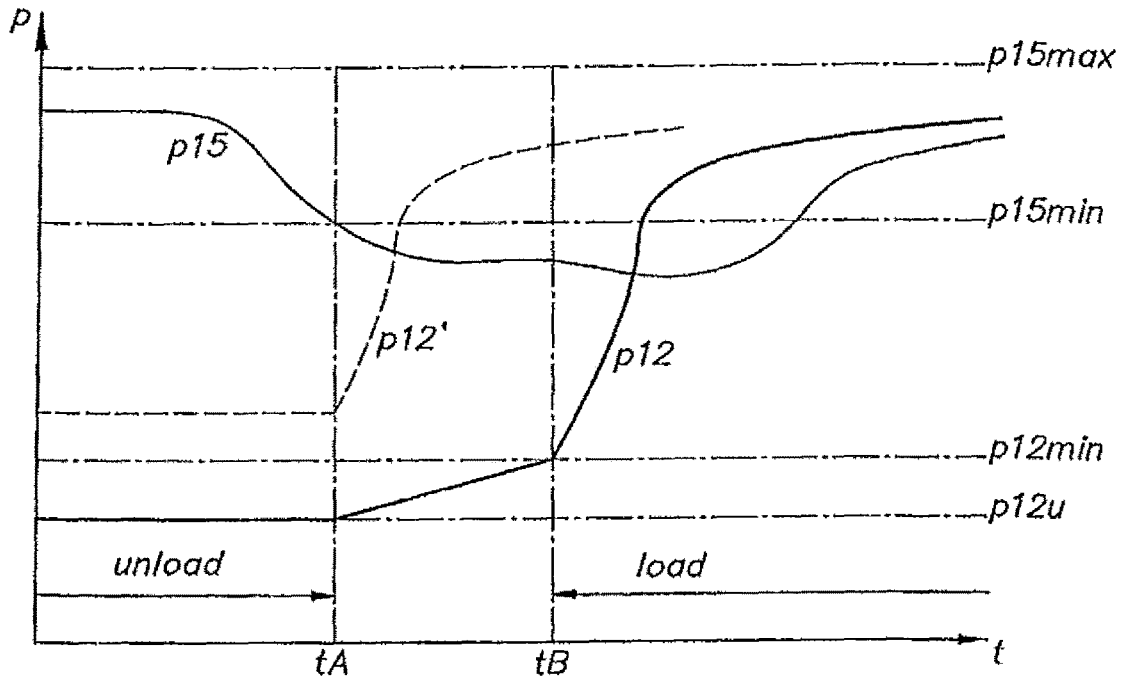
FIG. 3 shows a curve that indicates the pressure in the screw compressor of FIG. 1 as a function of time.

All this is shown in the diagram of FIG. 3 in which both the pressure p15 in the consumer network 15 and the pressure p12 in the pressure vessel 12 are shown as a function of time.

The period before the time tA is the unloaded state with constant pressure p12*u*.

The time tA is the moment at which the pressure p15 in the consumer network has fallen to the minimum pressure p15min desired by the user, whereby this time determines the transition from unloaded to loaded, whereby the controller according to the invention ensures that the inlet valve 6 is not immediately opened as is usual with the known screw compressors, but on the contrary is opened only later with a certain delay at the time tB, i.e. at a time that the pressure p12 in the pressure vessel 12 has reached a set required minimum pressure threshold p12min, above which there is no risk that undesired temperature peaks can occur in the outlet 10 of the compressor element 2 upon the sudden opening of the inlet valve 6.

This pressure p12min can be determined experimentally for a certain compressor 1, for example.

Figure 4:
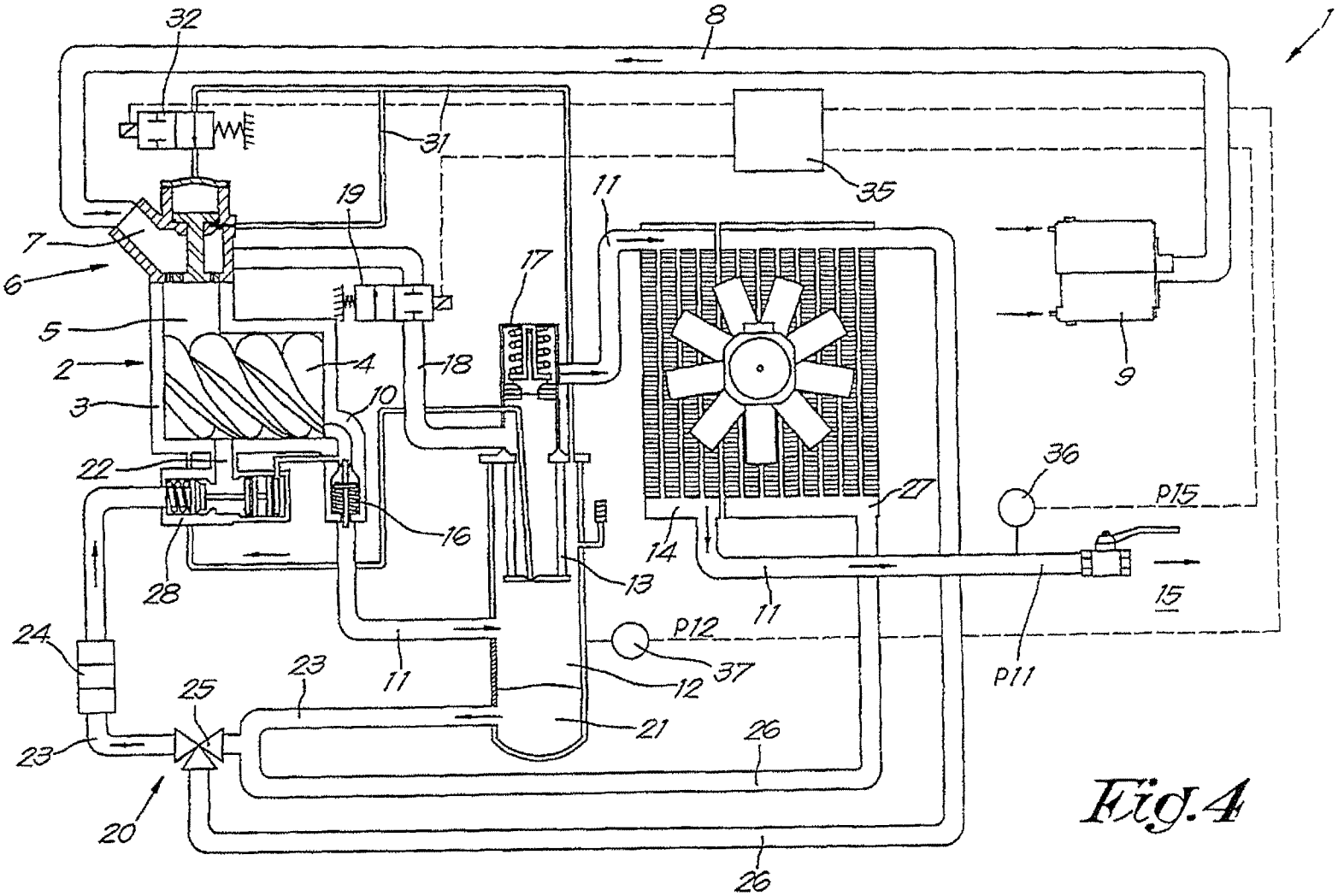
FIGS. 4 and 5 show the screw compressor of FIG. 1 but in a different situation than during operation.

In order to enable the pressure to rise from p12*u* to a safe value p12min during the delay tB−tA, in the example described here the blow-off valve 19 is closed at the time tA, as shown in FIG. 4.

The air that is drawn in via the calibrated passages 33 and 34 can thus not be blown off and ensures a partial pressure increase of the pressure p12 in the pressure vessel 12, whereby in an idealised presentation this pressure increase follows a linear curve in FIG. 3 whose rate of increase of the pressure p12 depends on the selected calibrated passages 33 and 34.

At the time tB when the pressure p12 in the pressure vessel 12 reaches the set safe minimum pressure p12min, the inlet valve 6 is suddenly fully opened while the blow-off valve 19 remains closed, as shown in FIG. 5.

As of that moment the pressure p12 increases rapidly as shown in FIG. 3, such that the pressure p15 in the consumer network 15 can quickly increase as also illustrated in FIG. 3.

For the user it is of course important that he can build up the required pressure in the consumer network 15 as quickly as possible, and that consequently the delay tB−tA is kept as short as possible, and in other words the pressure difference p12min−p12*u* is kept as small as possible, or thus for a given p12*u* the value of the required minimum pressure p12min is as low as possible for a reliable operation.

This value p12min can be set to a pressure corresponding to a more than required injection pressure p22min of 100 KPa (1 bar) for a reliable operation, for example. However, a faster reaction time of the consumer network can be obtained by setting this value p12min more specifically in the controller 35, and for example setting it lower in the circumstances when it can be.

The ideal value of p12min can be determined experimentally for example as a function of variable operating conditions such as ambient temperature, temperature of the liquid and similar, whereby the data obtained can be entered in the controller depending on how complex the controller 35 might be.

It goes without saying that if the pressure p12 in the pressure vessel 12 at the time tA is already greater than p12min, at that time no temperature peaks will occur that could lead to an undesired failure of the screw compressor 1 and that at that time no delay is required, or in other words the times tB and tA coincide or that, in other words, the opening of the inlet valve 6 and the closing of the blow-off valve 19 are done simultaneously at the time tA, The pressure p12 in the pressure vessel 12 develops as shown by the dashed line of curve p12'.

Instead of the time tB depending on a pressure measurement, alternatively it is not inconceivable to calculate or determine experimentally the delay tB−tA and to enter it in the controller 35.

For example, it is also possible to enter a limited number of discrete values in the controller for the pressure p12min or the delay tB−tA for a simplified control model, whereby these discrete values depend on a number of operating parameters for example, such as the time that the compressor element 2 has been running, the time that the compressor element has been stopped, the ambient temperature and similar that are parameters that influence the temperature and viscosity of the liquid and thereby also the risk of temperature peaks in the outlet 10.

It is clear for example that the delay tB−tA could be smaller if the screw compressor 1 is used in a warm environment (for example at a temperature above 30° C.), whereby the screw compressor 1 has run for long enough to warm up sufficiently and has not stopped for long enough to cool sufficiently, than if the screw compressor 1 is used in a cold environment and is only used briefly after a long stoppage.

Figures 6, 7:
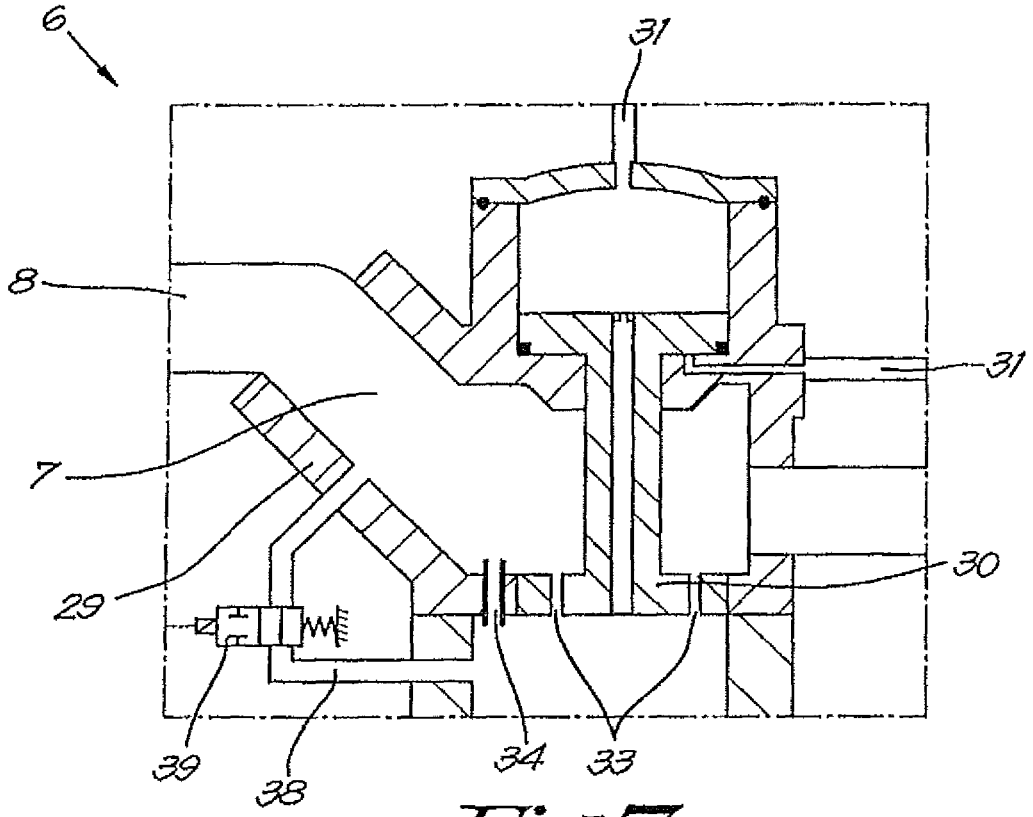
FIG. 6 presents a determination table for the choice of certain parameters for the screw compressor of FIG. 1.
FIGS. 7 and 8 show two possible variant embodiments of the part that is shown in FIG. 2.

This provides the possibility for example to enter a determination table in the controller, an example of which is shown in FIG. 6, to determine the delay tB−tA according to whether:

- the ambient temperature Ta is higher or lower than 30° C. for example;
- the runtime tRun of the compressor element 2 is longer or shorter than a period X;
- the stoppage time tStop of the compressor element is longer or shorter than a period Y or Z depending on the ambient temperature.

It is clear that as the pressure p12 in the pressure vessel 12 and the injection pressure p22 are closely related to one another, the same control can of course also be done by measuring the injection pressure p22 and passing it on to the controller and entering a minimum required injection pressure.

It is also clear that in the example of FIG. 1 an existing conventional liquid injected screw compressor can be used as a basis in which only the controller 35 has to be adapted to open the inlet valve 6 with a certain delay tB−tA upon a transition from unloaded to loaded.

FIG. 7 shows a variant of an inlet valve 6 according to the invention whereby in this case, with respect to the embodiment of FIG. 2, an additional bypass 38 is provided with a calibrated opening to bypass the poppet valve 30 of the inlet valve 6 for drawing in air when the inlet valve 6 is closed, whereby a controllable shut-off valve 39 is provided in this bypass, in this case in the form of an electric valve that is connected to the controller 35.

In this case the controller 35 is adapted such that the shut-off valve 39 is closed in an unloaded state and opened at the time tA, which results in the gradual increase of the pressure p12 in the pressure vessel during the delay tB−tA happening more quickly, such that the pressure p12min will be reached more quickly and in other words the delay tB−tA will be reduced with respect to the situation of FIG. 2.

Theoretically the additional bypass 38 could also be realised by not keeping the inlet valve 6 completely closed during the delay tB−tA, but slightly opening it.

Figure 8:
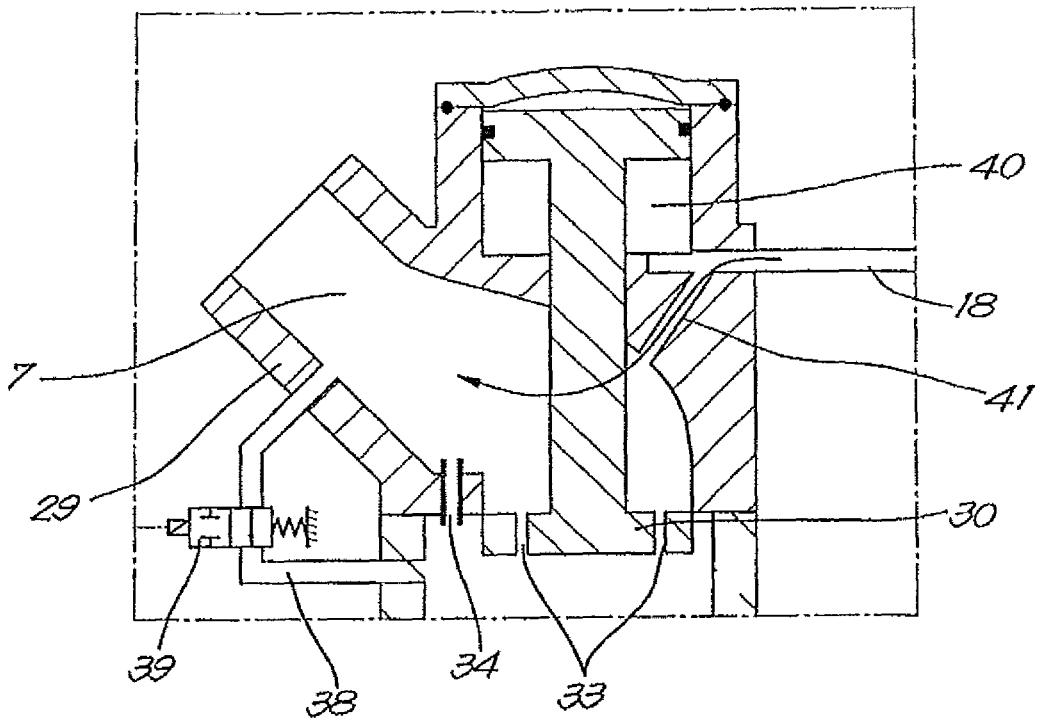

FIG. 8 shows another variant embodiment of an inlet valve 6, where in this case the blow-off valve 19 opens out into a control pressure chamber 40 of the inlet valve 6 via the blow-off branch 18 from where the blown off air flow opens out in the inlet 7 of the inlet valve 6 via a channel 41 as a type of extension of the blow-off branch 18.

In this case, the pressure of the blown off air then forms the control signal for opening the inlet valve 6, whereby the inlet valve 6 and the blow-off valve 19 are controlled together but in the opposite sense, i.e. when the blow-off valve 19 opens, the inlet valve 6 closes practically simultaneously and vice versa. Both valves 6 and 19 are thus not controllable independently of one another as in the case of FIG. 1.

In the case of FIG. 8 the inlet valve 6 is also equipped with an additional bypass 38 with shut-off valve 39 as in the case of FIG. 7.

In this case, upon a transition from unloaded to unloaded the controller 35 is adapted to control not only the inlet valve 6, but also the blow-off valve 19 simultaneously after a certain delay tB−tA, during which delay tB−tA the shut-off valve 39 of the bypass 38 is opened in order to make the pressure p12 gradually increase to a value p12min for reliable operation, insofar necessary.

During the delay tB−tA the bypass 38 is open and the inlet valve 6 is closed and the blow-off valve 19 is open, such that in a transitional period of a few seconds after to more flow is drawn in than blown out, such that the pressure p12 increases.

From the foregoing it is clear that, depending on the type of inlet valve 6 and blow-off valve 19, during a short delay tB−tA when the inlet valve 6 is closed, different means can be deployed in order to gradually increase the pressure p12 in the pressure vessel 12 to a safe value p12min in order to safely open the inlet valve 6 and not to have any problems with too high temperature peaks in the outlet 10.

It goes without saying that the invention is not limited to inlet valves 6 as shown, but can also be extended to other types of valves such as butterfly valves or similar.

The present invention is by no means limited to the embodiments described as an example and shown in the drawings, but a liquid injected screw compressor according to the invention and a controller for controlling the transition from unloaded to loaded and a method applied therewith can be realised in all kinds of variants, without departing from the scope of the invention.

The invention claimed is:

1. A liquid injected screw compressor, comprising:

a compressor element with an inlet and a controllable inlet valve to be able to close the inlet;

an outlet and a pressure pipe connected thereto that is connected to a downstream consumer network and a controllable blow-off valve for blowing off compressed gas at the inlet of the compressor element;

a liquid circuit with an injector for injecting liquid into the compressor element;

a liquid separator provided in the pressure pipe to separate liquid from the compressed gas and a pressure vessel to collect the separated liquid;

an injection pipe that connects the pressure vessel to the injector;

a controller for controlling the inlet valve and the blow-off valve during a transition from an unloaded state to a loaded state when a pressure in the consumer network falls to a set desired minimum network pressure, wherein in the unloaded state, the inlet valve is closed and the blow-off valve is open and maintains a compression pressure in the pressure vessel, and in the loaded state, the inlet valve is open and the blow-off valve is closed, wherein the controller is configured in a way such that upon a transition from the unloaded state to the loaded state, when an injection pressure lies below a minimum threshold which is lower than the compression pressure, the inlet valve remains closed and is opened with a delay so that the compression pressure in the pressure vessel is gradually increased during this delay in the opening of the inlet valve, and the inlet valve is only fully opened when the injection pressure reaches the minimum threshold, wherein the inlet valve and the blow-off valve can be controlled independently of one another and wherein the pressure in the pressure vessel during the transition from the unloaded state to the loaded state is increased by the fact that the controller is such that during the transition the open blow-off valve is closed while the inlet valve remains closed during the aforementioned delay, wherein the pressure is increased by including an additional bypass with a calibrated passage to bypass the inlet valve or drawing in gas when the inlet valve is closed, whereby a controllable shut-off valve is provided in this bypass, whereby the controller is such that the shut-off valve is closed in an unloaded state and opened during the transition from the unloaded to loaded state.

2. The liquid injected screw compressor according to claim 1, wherein the blow-off valve opens out in the input of the inlet valve.

3. The liquid injected screw compressor according to claim 1, wherein a calibrated passage is provided that forms a bypass across the inlet valve for drawing in gas when the inlet valve is closed, more specifically a passage between the input of the inlet valve and the inlet of the compressor element.

4. The liquid injected screw compressor according to claim 1, wherein the controller is such that the blow-off valve is closed at the start of the transition from unloaded to loaded.

5. The liquid injected screw compressor according to claim 1, wherein the shut-off valve of the additional bypass is opened at the start of the transition from the unloaded to loaded state.

6. The liquid injected screw compressor according to claim 1, wherein the inlet valve and the blow-off valve are able to be controlled together but in the opposite sense, and that the controller is such that during the transition from the unloaded to loaded state, at the time that the network pressure falls to the minimum network pressure, the inlet valve remains closed and the blow-off valve remains open and these valves are controlled simultaneously with a certain delay to open in the case of the inlet valve and to close in the case of the blow-off valve and that the pressure in the pressure vessel during this delay is increased by including an additional bypass with a calibrated passage to bypass the inlet valve for drawing in gas when the inlet valve is closed, whereby a controllable shut-off valve is provided in this bypass and whereby the controller is such that this shut-off valve is closed in an unloaded state and opened during the transition from the unloaded to loaded state.

7. The liquid injected screw compressor according to claim 6, wherein the shut-off valve of the additional bypass is opened at the start of the transition from the unloaded to loaded state.

8. The liquid injected screw compressor according to claim 1, wherein the controller is an electric or electronic controller and that the inlet valve and the blow-off valve are controlled by an electric valve.

9. The liquid injected screw compressor according to claim 1, wherein a pressure sensor is provided to measure the pressure in the pressure vessel or the injection pressure and that the controller is such that the opening of the inlet valve is initiated upon a transition from unloaded to loaded when the measured pressure is equal to a set value.

10. The liquid injected screw compressor according to claim 9, wherein the measured pressure is the injection pressure and that the set value of the injection pressure is the aforementioned minimum threshold.

11. The liquid injected screw compressor according to claim 9, wherein the measured pressure is the pressure in the pressure vessel and that the set value of the pressure is a calculated or experimentally determined pressure in the pressure vessel, above which value there is no failure of the screw compressor as a result of temperature peaks in the outlet of the compressor element during the transition from unloaded to loaded.

12. The liquid injected screw compressor according to claim 11, wherein the set pressure is a calculated pressure or an experimentally determined pressure that is as low as possible, with a safety margin taken into account or otherwise, and which is a function of the ambient temperature and of the temperature of the liquid.

13. The liquid injected screw compressor according to claim 8, wherein the controller is such that the delay in opening the inlet valve during the transition from unloaded to loaded is determined and the inlet valve is opened after the expiry of the delay.

14. The liquid injected screw compressor according to claim 8, wherein the delay is calculated or experimentally determined for a certain liquid injected screw compressor as a function of the desired or minimum threshold of the pressure in the pressure vessel or of the injection pressure; the ambient temperature; the time that the compressor element has been running to take account of the heating of the liquid and the time that the compressor element has been stopped to take account of the cooling of the liquid.

15. The liquid injected screw compressor according to claim 1, wherein the controller is a type of controller whereby the compressor element is not systematically stopped to switch over from loaded to unloaded.

16. An electric or electronic controller to control a transition of a liquid injected screw compressor according to claim 1 from unloaded to loaded, in order to prevent the injection pressure, at the time of opening the inlet valve, being lower than a minimum pressure below which undesired high temperature peaks could occur in the outlet of the compressor element.

17. A method for controlling a liquid injected screw compressor, comprising a compressor element with an inlet and a controllable inlet valve to be able to close the inlet; an outlet and a pressure pipe connected thereto that is connected to a downstream consumer network and a controllable blow-off valve for blowing off compressed gas to the inlet of the compressor element; a liquid circuit with an injector for injecting liquid into the compressor element; a liquid separator provided in the pressure pipe to separate liquid from the compressed gas and a pressure vessel to collect the separated liquid; an injection pipe that connects the pressure vessel to an injector for injecting liquid into the compressor element; a controller for controlling the inlet valve and the blow-off valve during a transition from an unloaded state to a loaded state when a pressure in the consumer network falls to a desired minimum network pressure, whereby in the unloaded state, the inlet valve is closed and the blow-off valve is open and maintains a compression pressure in the pressure vessel and in the loaded state, the inlet valve is open and the blow-off valve is closed, wherein during the transition from the unloaded state to the loaded state, the method comprises the following steps:

determining the pressure in the consumer network;

determining an injection pressure or a pressure in the pressure vessel at the time that the pressure in the consumer network falls to the minimum network pressure;

if the injection pressure or the pressure in the pressure vessel at that time is greater than or equal to a minimum value, then the inlet valve is immediately opened;

if the injection pressure or the pressure in the pressure vessel at that time is less than the minimum value which is lower than the compression pressure, then the inlet valve remains closed and is opened with a delay so that the compression pressure in the pressure vessel is gradually increased during this delay in the opening of the inlet valve; and, only fully opening the inlet valve when the injection pressure or the pressure in the pressure vessel reaches the minimum value, wherein the inlet valve and the blow-off valve can be controlled independently of one another and wherein the pressure in the pressure vessel during the transition from the unloaded state to the loaded state is increased by the Fact that the controller is such that during the transition the open blow-off valve is closed while the inlet valve remains closed during the aforementioned delay, wherein the pressure is increased by including an additional bypass with a calibrated passage to bypass the inlet valve or drawing in gas when the inlet valve is closed, whereby a controllable shut-off valve is provided in this bypass, whereby the controller is such that the shut-off valve is closed in an unloaded state and opened during the transition from the unloaded to loaded state.

18. The liquid injected screw compressor according to claim 1, wherein when the injection pressure is greater than or equal to the minimum threshold, the inlet valve is opened.

* * * * *